US009389544B2

(12) United States Patent
Murayama et al.

(10) Patent No.: US 9,389,544 B2
(45) Date of Patent: Jul. 12, 2016

(54) IMAGE FORMING APPARATUS

(71) Applicant: CANON KABUSHIKI KAISHA, Tokyo (JP)

(72) Inventors: Tatsuomi Murayama, Abiko (JP); Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/859,792

(22) Filed: Sep. 21, 2015

(65) Prior Publication Data

US 2016/0091834 A1 Mar. 31, 2016

(30) Foreign Application Priority Data

Sep. 26, 2014 (JP) ..... 2014-196384

(51) Int. Cl.
*G03G 15/00* (2006.01)
*G03G 15/16* (2006.01)

(52) U.S. Cl.
CPC ..... *G03G 15/1605* (2013.01)

(58) Field of Classification Search
CPC ..... G03G 15/1605
See application file for complete search history.

(56) References Cited

U.S. PATENT DOCUMENTS

2011/0069981 A1* 3/2011 Ito ..... G03G 15/0131 399/49
2014/0016965 A1* 1/2014 Tachiki ..... G03G 15/0189 399/121

FOREIGN PATENT DOCUMENTS

| | | | |
|---|---|---|---|
| JP | 04-174454 | A | 6/1992 |
| JP | 2006-259367 | A | 9/2006 |
| JP | 2007-057803 | A | 3/2007 |
| JP | 2009-139752 | A | 6/2009 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A controller measures a stop duration time when an intermediate transfer belt and a secondary transfer belt are stopped, and based on a measurement result, rotates and stops the intermediate transfer belt such that the stretched position by stretch rollers of the intermediate transfer belt is changed. At the same time, the controller rotates and stops the secondary transfer belt such that a stretched position by stretch rollers of the secondary transfer belt is changed. A time from starting to stopping the rotation of the intermediate transfer belt and a time from starting to stopping the rotation of the secondary transfer belt are overlapped.

5 Claims, 12 Drawing Sheets

IMAGE FORMING APPARATUS

BACKGROUND OF THE INVENTION

1. Field of the Invention

The present invention relates to an image forming apparatus transferring a toner image borne on a first belt to a recording medium borne on a second belt.

2. Description of the Related Art

As taught in Japanese Patent Application Laid-Open Publication No. 2009-139752 and in Japanese Patent Application Laid-Open Publication No. 2007-57803, an image forming apparatus in which an image is formed by secondary transferring a toner image primarily transferred from a photosensitive drum to an intermediate transfer belt to a recording medium borne on a secondary transfer belt stretched by a plurality of stretch rollers is widely used.

On the other hand, as taught in Japanese Patent Application Laid-Open Publication No. H04-174454, in an image forming apparatus where the toner image borne on a photosensitive belt is transferred to the recording medium, if the image forming apparatus is left unused for a long period of time, curling may be formed on the photosensitive belt, possibly causing transfer irregularities of the toner image. Therefore, in Japanese Patent Application Laid-Open Publication No. H04-174454, a timer is provided to measure a stop duration time of the photosensitive belt, and when the stop duration time reaches a threshold value, the photosensitive belt is rotated to cancel the curling.

Japanese Patent Application Laid-Open Publication No. 2007-57803 teaches an image forming apparatus having a pair of fur brushes in contact with an intermediate transfer belt and recover transfer residual toner therefrom. Japanese Patent Application Laid-Open Publication No. 2006-259367 teaches an image forming apparatus having a pair of fur brushes arranged to contact a secondary transfer belt and cleaning the belt.

In the image forming apparatus as described above where the toner image borne on the intermediate transfer belt is transferred to the recording medium borne on the transfer belt, transfer irregularities of the toner image may occur when curling occurs to the intermediate transfer belt, similar to the photosensitive belt of Japanese Patent Application Laid-Open Publication No. 4-174454. Further, it has been discovered according to the studies of the present applicant that transfer irregularities may occur not only by the curling of the intermediate transfer belt but also by curling of the transfer belt caused by a stretch roller.

On the other hand, noise may occur when a belt member such as a photosensitive belt is driven, as described in Japanese patent Application Laid-Open Publication No. H04-174454. Therefore, it is needed to stop such belt member as much as possible when images are not formed.

SUMMARY OF THE INVENTION

The present invention provides an image forming apparatus capable of reducing the frequency of occurrence of driving noise and the occurrence time of noise accompanying the removing of curling formed on both a first belt and a second belt.

According to an aspect of the present invention, an image forming apparatus includes a toner image forming portion configured to form a toner image on an image bearing member, an endless first belt bearing the toner image transferred from the image bearing member and rotating, an endless second belt bearing a recording medium and rotating, a plurality of first stretch rollers including a first transfer roller and stretching the first belt, a plurality of second stretch rollers including a second transfer roller capable of forming a transfer portion, in which the toner image is transferred to the recording medium, by nipping the first and second belts with the first transfer rollers and stretching the second belt, the transfer portion being formed such that a pressure added to the first belt and the second belt between the first and second transfer rollers is released in a state where the first and second belts are stopped, and a controller rotating and stopping the first belt such that a rotational position of the first belt with respect to the first stretch rollers is changed and rotating and stopping the second belt such that a rotational position of the second belt with respect to the second stretch rollers is changed, based on a stop duration time of at least either the first belt or the second belt, the controller overlapping a time from starting to stopping the rotation of the first belt and a time from starting to stopping the rotation of the second belt.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Now, the preferred embodiments of the present invention will be described with reference to the drawings.

Embodiment 1

(Image Forming Apparatus)

Figure 1:
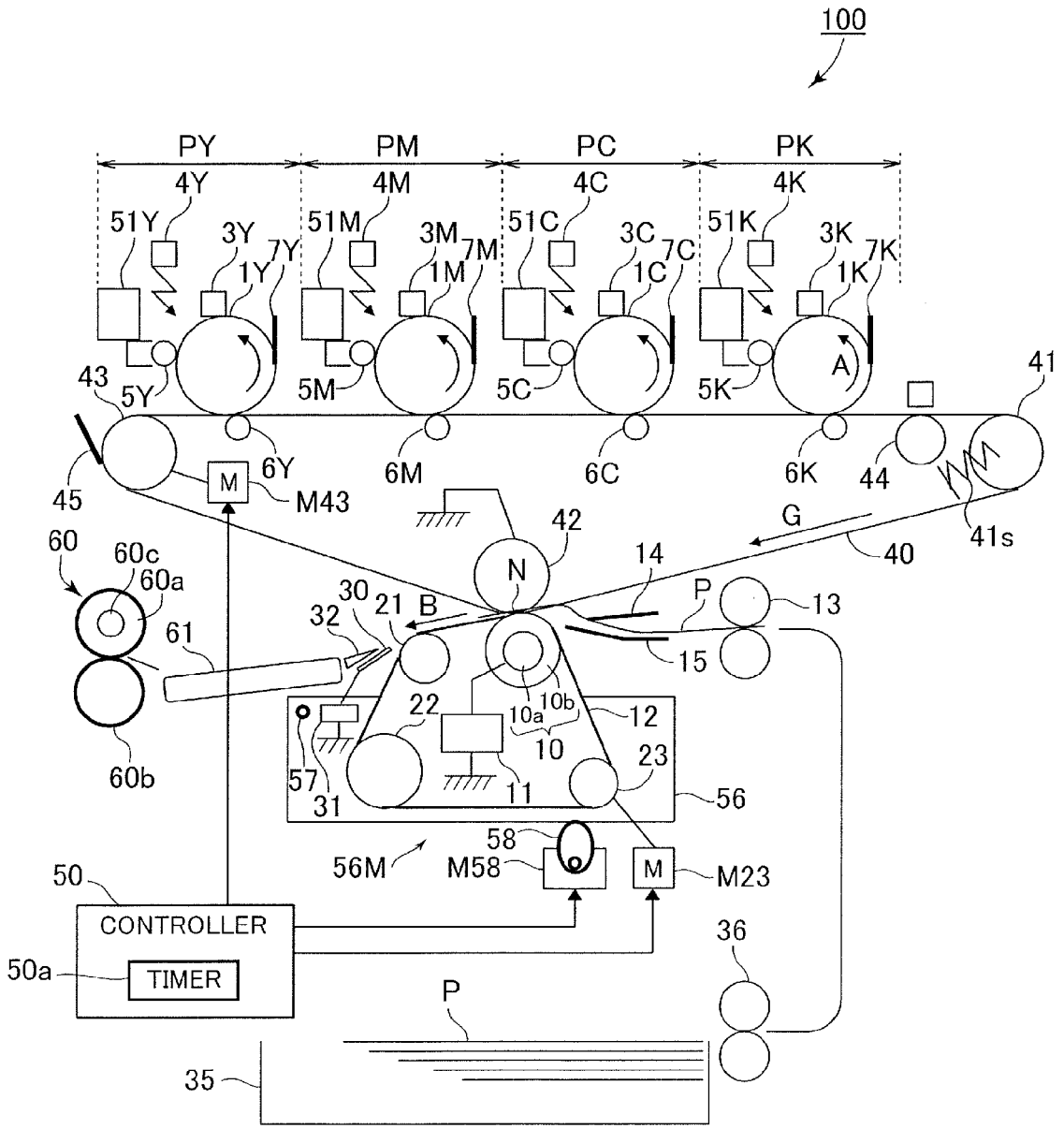
FIG. 1 is an explanatory view of a configuration of an image forming apparatus.

FIG. 1 is an explanatory view of a configuration of an image forming apparatus. As shown in FIG. 1, an image forming apparatus 100 is a tandem intermediate transfer type full-color printer in which image forming portions PY, PM, PC and PK are arranged along an upper surface of an intermediate transfer belt 40. The intermediate transfer-type apparatus has advantages such as an enhanced degree of freedom in the arrangement of a transfer portion, and high correspondence to various types of recording media.

In the image forming portion PY, a yellow toner image is formed on a photosensitive drum 1Y, which is then transferred to the intermediate transfer belt 40. In the image forming portion PM, a magenta toner image is formed on a photosensitive drum 1M, which is then transferred to the intermediate transfer belt 40. In the image forming portions PC and PK, cyan and black toner images are formed respectively on photosensitive drums 1C and 1K, and are transferred to the intermediate transfer belt 40.

The four color toner images transferred to the intermediate transfer belt 40 are conveyed to a transfer portion N, where they are secondarily transferred to a recording medium P. The recording medium P is taken out from a recording medium cassette 35, separated by a separating roller 36 to single sheets, and sent into a registration roller 13. The registration roller 13 delivers the recording medium P to the transfer portion N while synchronizing with the toner image on the intermediate transfer belt 40. An upstream upper guide 14 and an upstream lower guide 15 regulate a conveying path through which the recording medium P is conveyed from the registration roller 13 to the transfer portion N.

The recording medium P, to which the four color toner images are secondarily transferred, is conveyed by a conveying belt 61 and sent into the fixing unit 60, and receives heat and pressure in the fixing unit 60 to have the image fixed to a surface thereof. The fixing unit 60 applies given amounts of pressure and heat via a nip formed of a fixing roller 60*a* equipped with a heater 60*c* and a pressure roller 60*b*, and fixes the toner images on the recording medium P by melting.

(Image Forming Portion)

The image forming portions PY, PM, PC and PK are configured substantially in the same manner, except that the colors of toners in developing apparatuses 5Y, 5M, 5C and 5K differ, which are yellow, magenta, cyan and black. Therefore, in the following description, the image forming portion PY will be described, and the same explanation for other image forming portions PM, PC and PK will be omitted.

In the image forming portion PY, a charging unit 3Y, an exposure apparatus 4Y, a developing apparatus 5Y, a primary transfer roller 6Y and a drum cleaning device 7Y are disposed around the photosensitive drum 1Y. The photosensitive drum 1Y is provided with a photosensitive layer formed around an outer circumferential surface of an aluminum cylinder, and is rotated in a direction of arrow A at a predetermined processing speed.

The charging unit 3Y electrifies the photosensitive drum 1Y with homogeneous negative part potential. The exposure apparatus 4Y draws an electrostatic latent image of an image on the surface of the photosensitive drum 1Y by scanning, using a rotational mirror, a laser beam generated from an image signal having developed image data into a scan line.

The developing apparatus 5Y transfers a negatively charged toner to the electrostatic latent image on the photosensitive drum 1Y, and develops the electrostatic latent image to a toner image. The electrostatic latent image is an assembly of small dot images, and the density of the dot image can be changed to change the density of the toner image formed on the photosensitive drum 1Y. In the present example, the fixed image of yellow has a maximum reflection density of around 1.5 to 1.7, and an applied amount of toner at that time is approximately 0.4 to 0.6 mg/cm$^2$. A developer supplying portion 51Y feeds the equivalent amount of toner extracted from the developing apparatus 5Y when forming an image to the developing apparatus 5Y.

The primary transfer roller 6Y presses the intermediate transfer belt 40 toward the photosensitive drum 1Y, and forms a primary transfer portion between the photosensitive drum 1Y and the intermediate transfer belt 40. By applying DC voltage having a positive polarity to the primary transfer roller 6Y, the toner image having a negative polarity borne on the photosensitive drum 1Y is transferred to the intermediate transfer belt 40.

The drum cleaning device 7Y recovers transfer residual toner remaining on the surface of the photosensitive drum 1Y by bringing a cleaning blade in contact with the surface of the photosensitive drum 1Y.

(Intermediate Transfer Belt)

The intermediate transfer belt 40 is stretched by a driving roller 43, a tension roller 41 and a secondary transfer inner roller 42, and driven by the driving roller 43 and rotated in a direction of arrow G at a rotating speed of 250 to 300 [mm/sec]. The intermediate transfer belt 40 has a circumference of 2000 mm, and the photosensitive drums 1Y, 1M, 1C and 1K each have a diameter of 80 mm.

The intermediate transfer belt 40 has an elastic layer formed of rubber material with a thickness of 120 to 180 μm arranged on a base layer formed of a resin material such as polyimide, polycarbonate and the like with a thickness of 70 μm, and has a surface layer having a thickness of 5 to 10 μm formed on the surface of the elastic layer, so that the total thickness of the belts is 200 to 250 μm. The rubber material can be urethane rubber, chloroprene rubber and the like. The attachment force of the toner to the surface of the intermediate transfer belt 40 is weakened so that toner can be easily transferred to the recording medium P at a transfer portion N. A volume resistivity of the intermediate transfer belt 40 is modified to $1\times1^{9}$ to $1\times10^{14}$ [Ω·cm] by adding an appropriate amount of carbon black as an antistatic agent to the respective layers.

The surface layer can be formed of one kind of resin material, such as polyurethane, polyester, epoxy resin, fluororesin and the like. It is also possible to mix two or more kinds of elastic materials such as elastic rubber, elastomer, isobutylene-isoprene rubber and the like, and having one or more than two kinds of powder particles such as fluororesin for reducing surface energy and improving lubricity, or powder particles with various particle diameters scattered for use.

The tension roller 41 is biased by pressure springs 41*s* arranged at both ends of a rotation axis to be protruded toward the intermediate transfer belt 40, and applies a substantially constant tension of approximately 20 to 50 N (approximately 2 to 5 kgf) to the intermediate transfer belt 40 in the conveyance direction. A belt cleaning unit 45 brings a cleaning blade into sliding contact with the surface of the intermediate transfer belt 40, and recovers the transfer residual toner remaining on the surface of the intermediate transfer belt 40.

(Secondary Transfer Belt)

As shown in FIG. 1, a secondary transfer belt unit 56 has a secondary transfer belt 12 bearing a recording medium P and passing the transfer portion N. By using the secondary transfer belt 12, the recording medium P can be separated easily from the intermediate transfer belt 40 after the toner image is transferred in the transfer portion N. Further, since the recording medium can be conveyed stably in the transfer portion N, it becomes possible to suppress image defects occurring by the position of the recording medium being unstable when the recording medium passes the transfer portion N.

The secondary transfer belt unit 56 has the secondary transfer belt 12 stretched around a secondary transfer outer roller 10, a separating roller (conveying surface forming roller) 21, a tension roller 22, and a drive roller 23. The circumference of the secondary transfer belt 12 is 200 mm.

The secondary transfer belt 12 is formed of a resin material whose volume resistivity is modified to $1\times10^{9}$ to $1\times10^{14}$ [Ω·cm] by adding an appropriate amount of carbon black as an antistatic agent to a resin material such as polyimide or polycarbonate. The secondary transfer belt 12 has a single layer structure with a thickness of 0.07 to 0.1 mm. The secondary transfer belt 12 has a Young's module value of 100 MPa or greater and smaller than 10 GPa measured via tensile testing (JIS K 6301).

The secondary transfer outer roller 10 has an elastic layer 10*b* formed of an ion-conductive foamed rubber (NBR rubber) on an outer circumference of a stainless steel round bar core metal 10*a*, so that the outer diameter thereof is 24 mm. The elastic layer 10*b* has a ten-point-average surface roughness Rz of 6.0 to 12.0 [μm], and an Asker-C hardness of around 30 to 40. The secondary transfer outer roller 10 has a resistance value of $1\times10^{5}$ to $1\times10^{7}$ [Ω] measured by applying 2 kV under a normal temperature and normal humidity environment (N/N: 23° C., 50% RH).

The secondary transfer inner roller 42 supports the inner side surface of the intermediate transfer belt 40 positioned at the transfer portion N, and forms a transfer portion N of toner image between the intermediate transfer belt 40 supported by the secondary transfer inner roller 42 and the secondary transfer belt 12. A secondary transfer power supply 11 having a variable output current is connected to secondary transfer outer roller 10

The output voltage of a secondary transfer power supply 11 is subjected to constant current control, for example, so that a transfer current of +40 to 60 μA is flown. The secondary transfer power supply 11 applies a transfer voltage to the secondary transfer outer roller 10, and subjects the toner image borne on the intermediate transfer belt 40 to secondary transfer to the recording medium P on the secondary transfer belt 12. Accompanying the secondary transfer of the toner image, the recording medium P is statically attached to the secondary transfer belt 12.

The separating roller 21 disposed downstream from the secondary transfer outer roller 10 also functions as a separating roller of the recording medium. After reaching the separating roller 21, the recording medium P on the secondary transfer belt 12 is separated by the curvature of the curved surface of the secondary transfer belt 12 along the circumferential surface of the separating roller 21 from the secondary transfer belt 12. The recording medium P having been separated from the secondary transfer belt 12 is conveyed by the conveying belt 61 and sent to the fixing unit 60. A separation claw 32 prevents the recording medium P separated from the secondary transfer belt 12 from being statically attracted again to the secondary transfer belt 12.

The drive roller 23 is driven by a drive motor M23, and rotates the secondary transfer belt 12 in the direction of arrow B. Both ends of the tension roller 22 are biased toward the secondary transfer belt 12 by pressure springs, by which a predetermined tension is applied to the secondary transfer belt 12.

The recording medium P separated from the secondary transfer belt 12 is conveyed to the fixing unit 60 by the conveying belt 61. The recording medium to which the image has been fixed by the fixing unit 60 is discharged to an exterior of the image forming apparatus 100. The separation claw 32 prevents the recording medium P having been separated from the secondary transfer belt 12 from winding around the secondary transfer belt 12 again.

(Contact-Separation Mechanism)

Figure 2A:
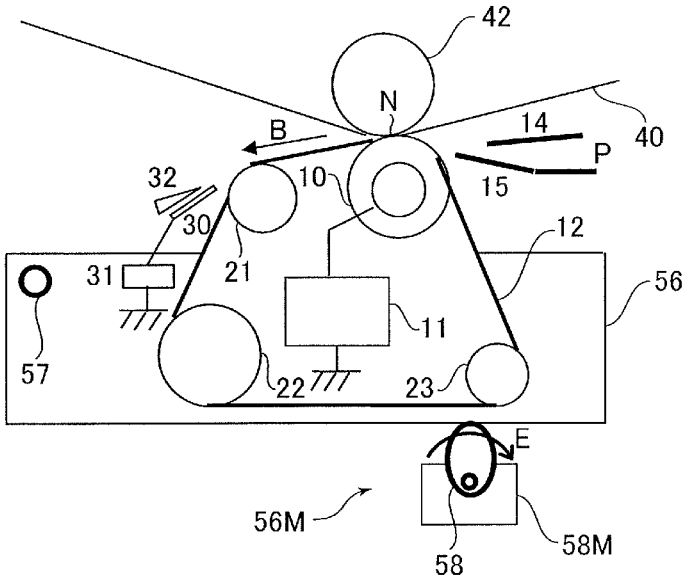
FIG. 2A is a schematic diagram illustrating a secondary transfer belt unit in a contact state.
Figure 2B:
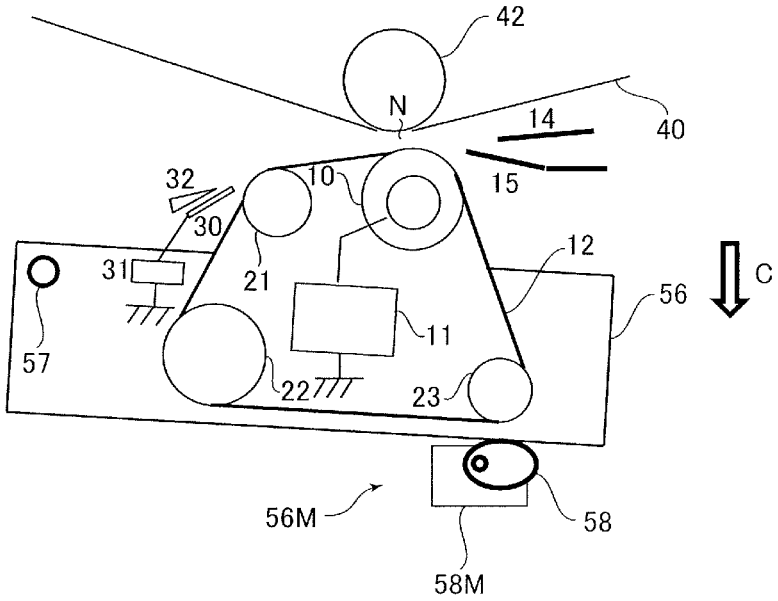
FIG. 2B is a schematic diagram illustrating a secondary transfer belt unit in a separated state.

FIGS. 2A and 2B are explanatory views of a contact-separation mechanism of a secondary transfer belt unit. FIG. 2A shows a contact state, and FIG. 2B shows a separated state.

As shown in FIG. 1, the intermediate transfer belt 40 as an example of a first belt in an endless state is stretched by a plurality of stretch rollers (first stretch rollers 41, 42 and 43), and rotates while bearing a toner image transferred from the photosensitive drum 1Y as an example of an image bearing member. The secondary transfer belt 12 as an example of a second belt in an endless state is stretched by a plurality of stretch rollers (second stretch rollers 10, 21, 22 and 23), and rotates while bearing a recording medium capable of forming a transfer portion N of toner image to the recording medium with the intermediate transfer belt 40. The secondary transfer inner roller 42 and the secondary transfer outer roller 10 as an example of a pair of transfer rollers can nip the intermediate transfer belt 40 and the secondary transfer belt 12 in the transfer portion N. A controller 50 controls a contact-separation mechanism 56M, and when the intermediate transfer belt 40 and the secondary transfer belt 12 are in a stopped state, it releases the pressure applied to the intermediate transfer belt 40 and the secondary transfer belt 12 via the secondary transfer inner roller 42 and the secondary transfer outer roller 10.

When a pressurizing cam 58 rotates in the direction of arrow E, as shown in FIG. 2A, the secondary transfer belt unit 56 rotates in the direction of arrow C pivoting around a rotation axis 57, as shown in FIG. 2B, and separates the secondary transfer belt 12 from the intermediate transfer belt 40.

As described, the image forming portion PY as an example of a toner image forming portion forms a toner image on the photosensitive drum 1Y as an example of the image bearing member. The intermediate transfer belt 40 as an example of an endless first belt is stretched by a plurality of stretch rollers, and rotates while bearing the toner image transferred from the photosensitive drum 1Y. The secondary transfer belt 12 as an example of an endless second belt is stretched by a plurality of stretch rollers, rotates while bearing the recording medium, and can form a transfer portion N of toner image to the recording medium with the intermediate transfer belt 40. The secondary transfer inner roller 42 and the secondary transfer outer roller 10 as examples of a pair of transfer rollers apply pressure to the intermediate transfer belt 40 and the secondary transfer belt 12. When the intermediate transfer belt 40 and the secondary transfer belt 12 are in a stopped state, the pressure applied to the intermediate transfer belt 40 and the secondary transfer belt 12 from the secondary transfer inner roller 42 and the secondary transfer outer roller 10 is released.

(Curling)

As shown in FIG. 2B, when an inactive state continues for a long time in the image forming apparatus 100, curling occurs to the intermediate transfer belt 40 and the secondary transfer belt 12, and inconvenience may occur in forming images. When the apparatus is inactive, the secondary transfer belt 12 remains stretched by a plurality of stretch rollers (10, 21, 22 and 23) with a given tension. When this state continues for a long time, the winding shape will be retained in the portion wound around the stretch rollers (10, 21, 22 and 23) of the secondary transfer belt 12, causing a so-called "curling". When image forming is performed by rotating the secondary transfer belt 12 where "curling" has occurred, the secondary transfer belt 12 may be vibrated, and disorder of the respective color images transferred to the recording medium P may occur. In another example, pressure irregularities and gaps may occur at the curled portions or the difference in levels before and after the curled portions of the secondary transfer belt 12 and the intermediate transfer belt 40 when the belts pass the transfer portion N, and defective transfer of the toner image may occur.

(Level of Occurrence of Curling)

Figure 3:
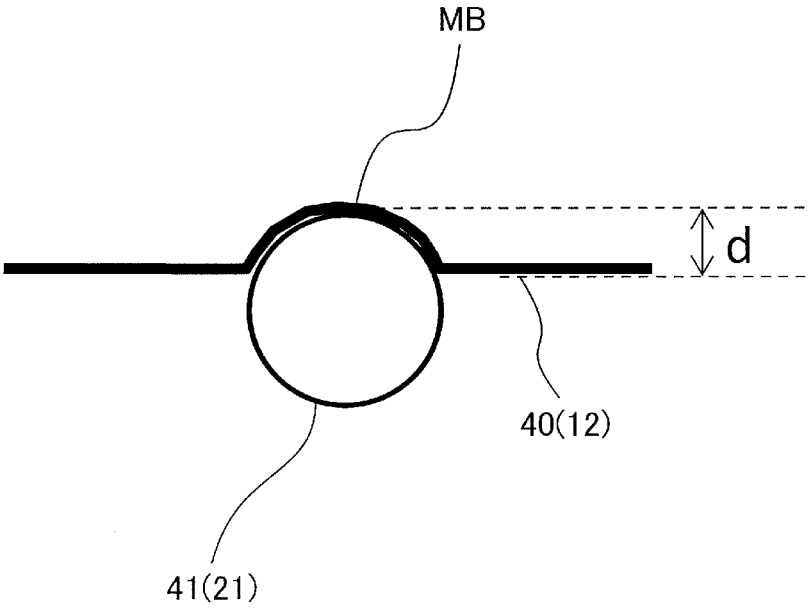
FIG. 3 is an explanatory view of a definition of curling of an intermediate transfer belt and a secondary transfer belt.
Figure 4:
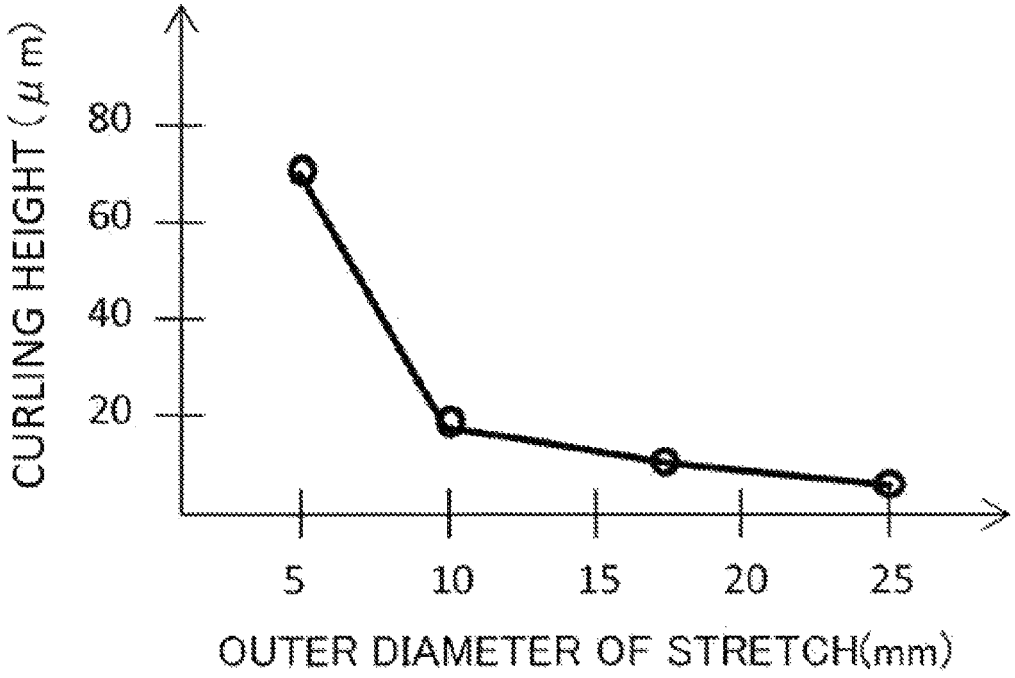
FIG. 4 is an explanatory view of a relationship between outer diameter of stretch roller and curling height.
Figure 5A:
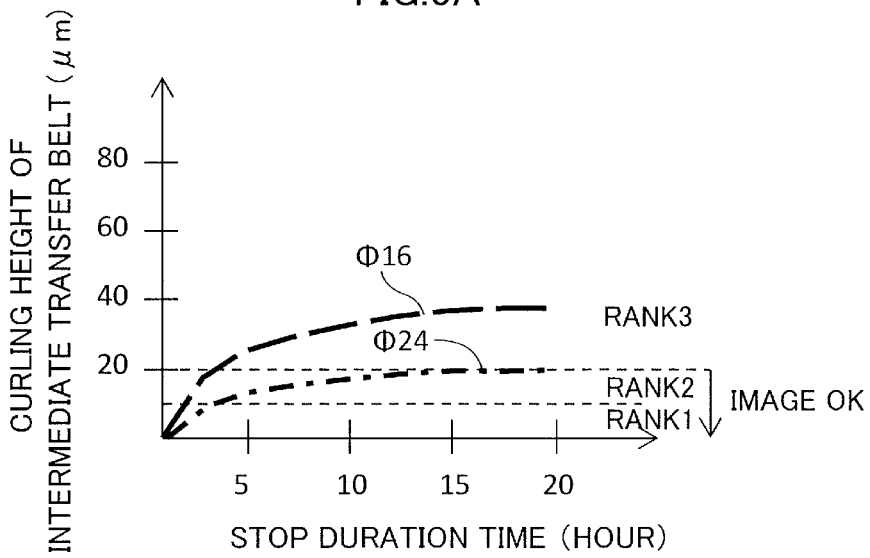
FIG. 5A is an explanatory view showing a relationship between curling height of intermediate transfer belt and degree of influence to output image.
Figure 5B:
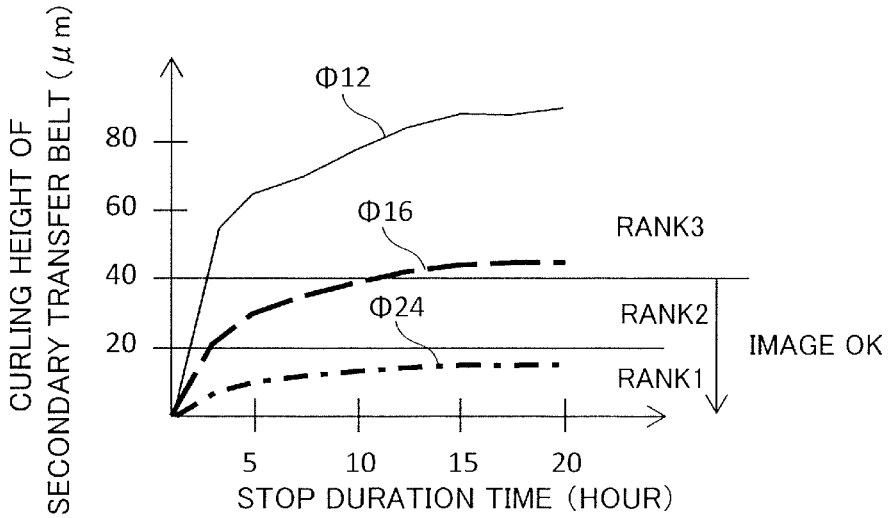
FIG. 5B is an explanatory view showing a relationship between curling height of secondary transfer belt and degree of influence to output image.

FIG. 3 is an explanatory view of a definition of curling of the intermediate transfer belt and the secondary transfer belt. FIG. 4 is an explanatory view showing the relationship between outer diameter of the stretch roller and curling height. FIGS. 5A and 5B are explanatory views showing the relationship between curling height and level of influence to output image.

As shown in FIG. 3, a level of occurrence of curling in the intermediate transfer belt 40 and the secondary transfer belt 12 are quantified. A curling height d is measured using a laser shape measurement apparatus, for example, while stretching both ends of a curling portion MB in a state where tension for normal operation is applied.

As shown in FIG. 4, in the example where the secondary transfer belt 12 is left unused for two hours in a state where normal tension during operation is applied thereto, the curling height d tends to increase if the outer diameter of the stretch rollers (10, 21, 22, and 23) is small.

As shown in FIGS. 5A and 5B, materials of the belt, presence or absence of an elastic layer, thicknesses, tension, winding angles, outer diameters of the stretch rollers and so on differ between the intermediate transfer belt 40 and the secondary transfer belt 12, so that the levels of occurrence of curling differ between the belts. However, in both belts, there was a tendency that the variation with time of curling height d increased as the outer diameter of the stretch rollers was reduced.

FIGS. 5A and 5B show an acceptable level of the curling height d evaluated through output image in dotted lines. Rank 1 is a curling height d of a level where transfer irregularities cannot be observed even in a toner image having a uniform thickness throughout the whole image. Rank 2 is a curling height d of a level where transfer irregularities cannot be observed in a practical image such as character image and photographic image. Rank 3 is a curling height d of a level where transfer irregularities can be observed easily even in a practical image. Therefore, in FIGS. 5A and 5B, the curling height up to rank 2 is evaluated to be a level that will not deteriorate the quality of the image.

As shown in FIG. 5A, in the intermediate transfer belt 40, the curling height d determined as ranks 1 and 2 causing no problem to the image is lower than the secondary transfer belt 12. This is because the intermediate transfer belt 40 is in contact with the toner image at the transfer portion N, so that the influence that the belt 40 has on transfer irregularities is more direct compared to the secondary transfer belt 12 that is in contact with the rear surface of the recording medium.

As shown in FIG. 5B, in the secondary transfer belt 12, the diameter of the stretch rollers becomes smaller than the intermediate transfer belt 40, so that the increase of curling height is increased with respect to the elapse of time. The diameter of the stretch rollers (10, 21, 22, and 23) of the secondary transfer belt 12 is 012 to 24, whereas the diameter of the stretch rollers (41, 42, and 43) of the intermediate transfer belt 40 is 016 to 24.

As a result, the acceptable unused time from the stopping of the image forming apparatus 100 to when the defective transfer caused by curling becomes a problem differs between the intermediate transfer belt 40 and the secondary transfer belt 12. In the intermediate transfer belt 40, the stretch roller with a minimum diameter has an outer diameter of 16 mm, so that the acceptable unused time is three hours. On the other hand, in the secondary transfer belt 12, the stretch roller having the minimum diameter has an outer diameter of 12 mm, so that the acceptable unused time is two hours and ten minutes.

In order to remove the curling of the intermediate transfer belt 40, the belt should be driven for a fixed time when the stop duration time reaches three hours, to remove the curling. As for the secondary transfer belt 12, the belt should be driven for a fixed time when the stop duration time reaches two hours and ten minutes, to remove the curling.

However, in the case of the image forming apparatus 100 in which an intermediate transfer belt 40 stretched by a plurality of stretch rollers and a secondary transfer belt 12 stretched by a plurality of stretch rollers exist, the number and duration time of driving the belts for removing curling is increased. The noise caused by the belt driving operation for removing the curling is a noise that occurs suddenly in a state where the image forming apparatus 100 is stopped and the operation noise thereof has ceased, so that the noise attracts the attention of users and may cause unnecessary irritation.

In other words, according to a configuration where a control is performed to prevent curling by moving the belt when stop duration times of the belts have exceeded a fixed time, if the respective belts are each operated at the best timing determined for each belt, the chances of driving the belts in the stopped state are increased. The noise caused by this operation of the belts may bother the user since the noise occurs after the image forming apparatus has stopped and the noise from the apparatus has ceased.

In the following embodiment, in consideration of the above situation, the timing for driving the belts for removing the curling of the plurality of belts is controlled in order to significantly reduce the number and time of operation of the belts for removing curling.

(Control According to Embodiment 1)

Figure 6:
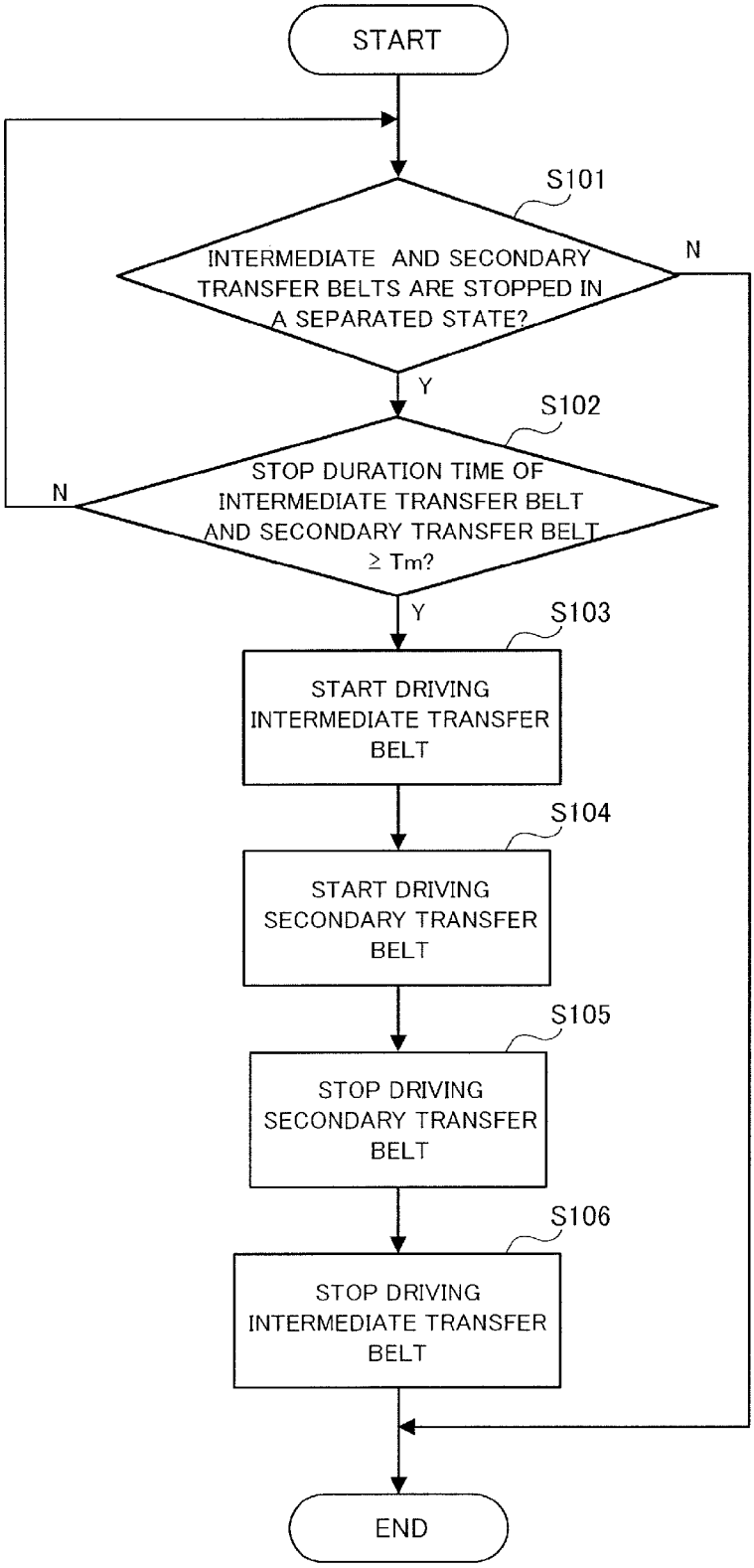
FIG. 6 is a flowchart of control according to Embodiment 1.
Figure 7A:
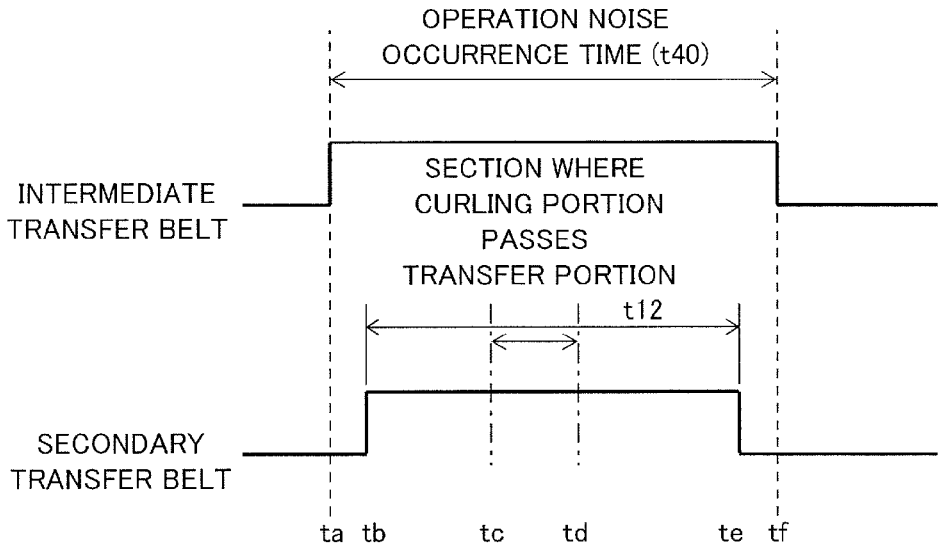
FIG. 7A is a time chart showing operations of an intermediate transfer belt and a secondary transfer belt when a driving time of the secondary transfer belt is included in a driving time of the intermediate transfer belt.
Figure 7B:
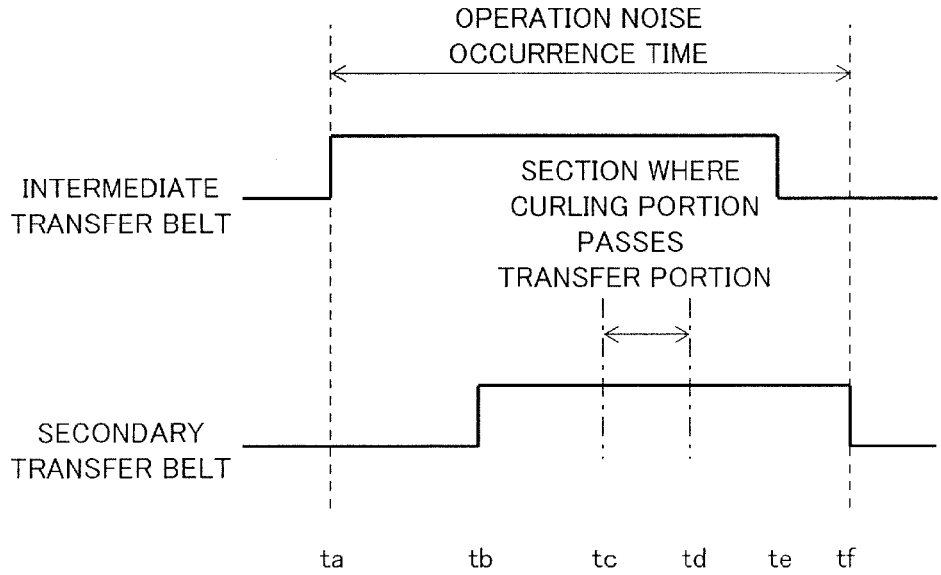
FIG. 7B is a time chart showing operations of the intermediate transfer belt and the secondary transfer belt when the driving time of the secondary transfer belt is not included in the driving time of the intermediate transfer belt.

FIG. 6 is a flowchart of a control according to Embodiment 1. FIG. 7 is an explanatory view of the effect of the control according to Embodiment 1. As shown in FIG. 2B, after the previous image forming job has been ended, the secondary transfer belt 12 is stopped in a state being separated from the intermediate transfer belt 40 via the contact-separation mechanism 56M (S101: Y).

As shown in FIG. 6 with reference to FIG. 1, when the stop duration times of the secondary transfer belt 12 and the intermediate transfer belt 40 respectively reach thresholds Tm (S102: Y), the controller 50 rotates the secondary transfer belt 12 and the intermediate transfer belt 40 in a separated state for respective rotation times determined for each belt (S103 to S106).

As shown in FIG. 7 (*a*), the controller 50 starts the rotational driving of the intermediate transfer belt 40 at time to (S103), and starts the rotational driving of the secondary transfer belt 12 at time tb (S104). Thus, during time tc and time td, the curling portion MB of the secondary transfer belt 12 shown in FIG. 3 passes the transfer portion (secondary transfer outer roller 10). The controller 50 stops the rotational driving of the secondary transfer belt 12 at a time to when a stretch position move time t12 of the secondary transfer belt 12 has elapsed from time tb (S105). Further, the controller 50 stops the rotational driving of the intermediate transfer belt 40 at time tf when a stretch position move time t40 of the intermediate transfer belt 40 has elapsed from time to (S106). In other words, the controller 50 rotates and stops the intermediate transfer belt 40 so that rotation positions of the intermediate transfer belt 40 with respect to the first stretch rollers 41, 42 and 43 are changed, and also rotates and stops the secondary transfer belt 12 so that rotation positions of the secondary transfer belt 12 with respect to the second stretch rollers 10, 21, 22 and 23 are changed, based on at least either the stop duration time of the intermediate transfer belt 40 or the secondary transfer belt 12. Further according to the present embodiment, the controller 50 measures the stop duration time of either the intermediate transfer belt 40 or the secondary transfer belt 12, and determines whether the stop duration times of the intermediate transfer belt 40 and the secondary transfer belt 12 have exceeded a threshold Tm, but according to another example, it is also possible to measure only one stop duration time, and to have the other belt driven based on the one stop duration time.

As shown in FIG. 5B, after stopping the intermediate transfer belt 40 and the secondary transfer belt 12, the curling that influences the output image the earliest is the stretched position of the secondary transfer belt 12 stretched by the stretch roller (23) having an outer diameter of 12 mm. Therefore, the threshold Tm of the stop duration time is set to one hour 45 minutes, earlier than the time when the curling at the stretched position caused by the stretch roller (23) with an outer diameter 12 mm influences the output image.

In Embodiment 1, the change of the stretched position of the intermediate transfer belt 40 is executed at threshold time Tm regarding the secondary transfer belt 12, so that the increase of curling height d can be prevented infallibly before the curling height d of the curling portion MB of the intermediate transfer belt 40 affects the image.

In Embodiment 1, the stretch position move time t40 of the intermediate transfer belt 40 and the stretch position move time t12 of the secondary transfer belt 12 can be set arbitrarily. Therefore, it is possible to easily set the stretch position move time t40 of the intermediate transfer belt 40 and the stretch position move time t12 of the secondary transfer belt 12 so that all the stretched positions of the plurality of stretch rollers during stop do not overlap with the stretched positions of the multiple rollers after the movement.

In Embodiment 1, the stretch position move time t40 of the intermediate transfer belt 40 is set so that the intermediate transfer belt 40 is moved for 40 mm in the process of being accelerated to 300 [mm/sec]. Further, the stretch position move time t12 of the secondary transfer belt 12 is set so that the secondary transfer belt 12 is moved for 30 mm in the process of being accelerated to 300 [mm/sec]. Therefore, the time during which the intermediate transfer belt 40 and the secondary transfer belt 12 are rotated is 0.2 seconds or less, so that the necessary change of stretched positions can be completed without attracting the attention of the user excessively.

In Embodiment 1, the curling of the intermediate transfer belt 40 and the secondary transfer belt 12 is not sufficiently recovered during the stretch position move time. The rotation during the stretch position move time is performed to prevent the curling of the intermediate transfer belt 40 and the secondary transfer belt 12 from increasing to a rank 3 level shown in FIGS. 5A and 5B, and the curling of the stretched positions while the stretch rollers are stopped is gradually recovered during the stop duration time after the movement. Therefore, the stretch position move time is set so that the belts are stopped at positions where the stretch roller portions do not come to the downstream stretch roller positions.

As described above, a timer 50*a* as a portion of the function of the controller 50 measures the stop duration time when the intermediate transfer belt 40 and the secondary transfer belt 12 are stopped. Based on the result of measurement of the timer 50*a*, the controller 50 as an example of a controller rotates the intermediate transfer belt 40 and stops the same so that the stretched positions of the intermediate transfer belt 40 caused by the stretch rollers are changed. At the same time, the controller 50 rotates the secondary transfer belt 12 and stops the same so that the stretched positions of the secondary transfer belt 12 caused by the stretch rollers are changed.

(Effect of Embodiment 1)

According to Embodiment 1, the stopped state of the intermediate transfer belt 40 and the secondary transfer belt 12 is detected, and when the stopped state is continued for a determined time or longer, the intermediate transfer belt 40 and the secondary transfer belt 12 are rotated to suppress the occurrence of image defects caused by curling.

According to Embodiment 1, at least a portion of a time t40 from starting to stopping of the rotation of the intermediate transfer belt 40 and a time t12 from starting to stopping of the rotation of the secondary transfer belt 12 are overlapped. Therefore, compared to the case where the time t40 and the time t12 do not overlap, the number of occurrence of operation noise of the image forming apparatus 100 is reduced. Therefore, the occurrence frequency driving noise that occurs when performing belt drive control from the stopped state will be reduced. In Embodiment 1, the shorter one between the time t40 and the time t12 is arranged within the longer one. As shown in FIG. 7 (*a*), the drive timing of the belt having a shorter rotation time is set to be included in the drive timing of the belt having a longer rotation time. Therefore, compared to the case where the time t40 and the time t12 are mutually partially overlapped, the total occurrence time of operation noise of the image forming apparatus 100 can be reduced. Thus, the occurrence time of the operation noise of the belts can be shortened.

In Embodiment 1, when changing the stretched positions of the intermediate transfer belt 40 and the secondary transfer belt 12 by the stretch rollers, the intermediate transfer belt 40 and the secondary transfer belt are mutually rotated for different periods of time in separated states. Thus, a most suitable amount of movement can be set for each of the intermediate transfer belt 40 and the secondary transfer belt 12.

In Embodiment 1, the amount of movement from when the rotation of the secondary transfer belt 12 is started to when it is stopped is 20 mm or greater and 100 mm or smaller. The time from when the rotation of the secondary transfer belt 12 is started to when it is stopped is 0.1 seconds or longer and 0.5 seconds or shorter. Therefore, unless the user is extremely aware, the user will not notice the movement of the secondary transfer belt 12.

Embodiment 2

According to Embodiment 2, a portion of the control for moving the stretched positions of the intermediate transfer belt 40 and the secondary transfer belt 12 caused by the stretch rollers during the stopped period in the image forming apparatus shown in FIGS. 1 through 5 differs from Embodiment 1. The areas common with Embodiment 1 will not be described again in Embodiment 2.

(Control According to Embodiment 2)

Figure 8:
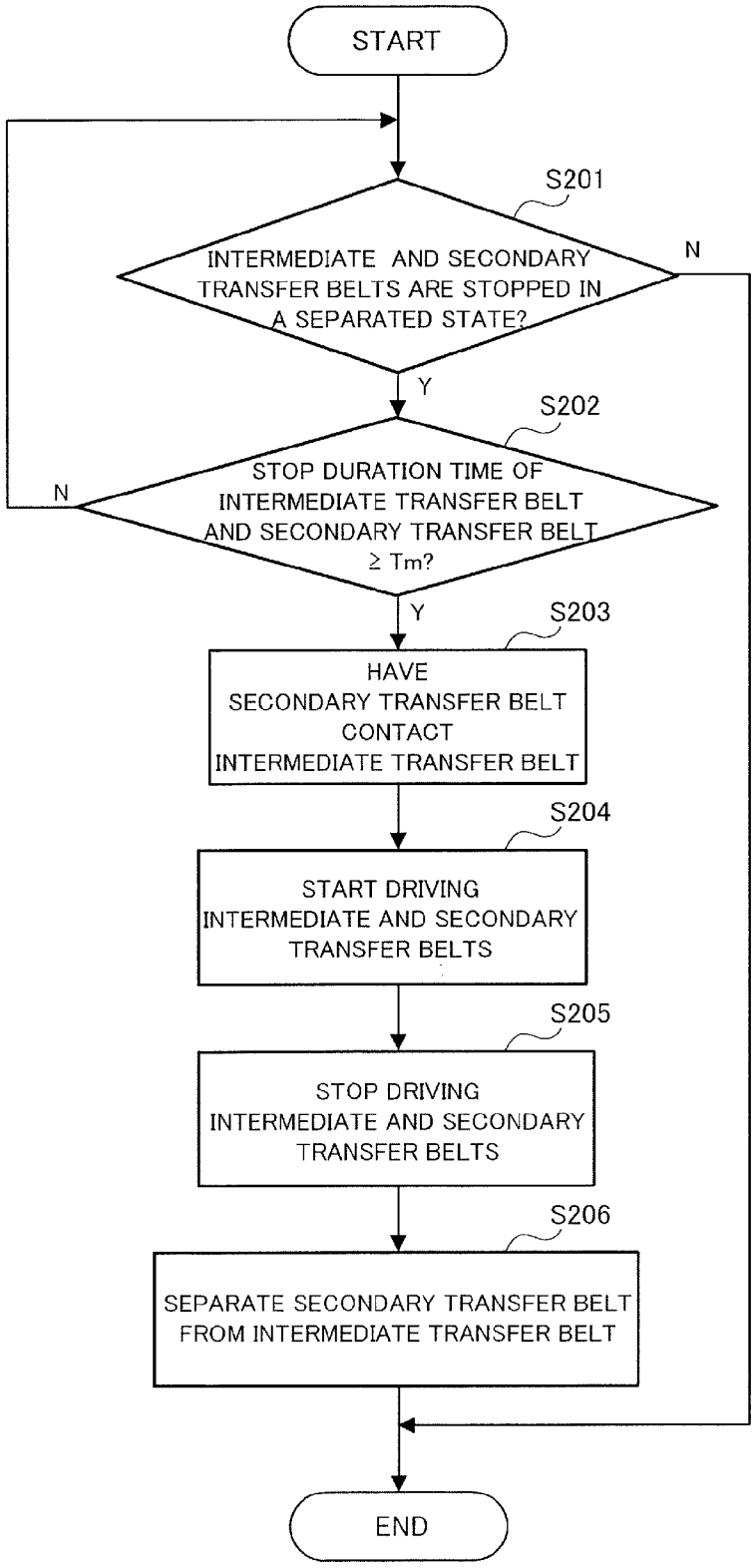
FIG. 8 is a flowchart of control according to Embodiment 2.
Figure 9A:
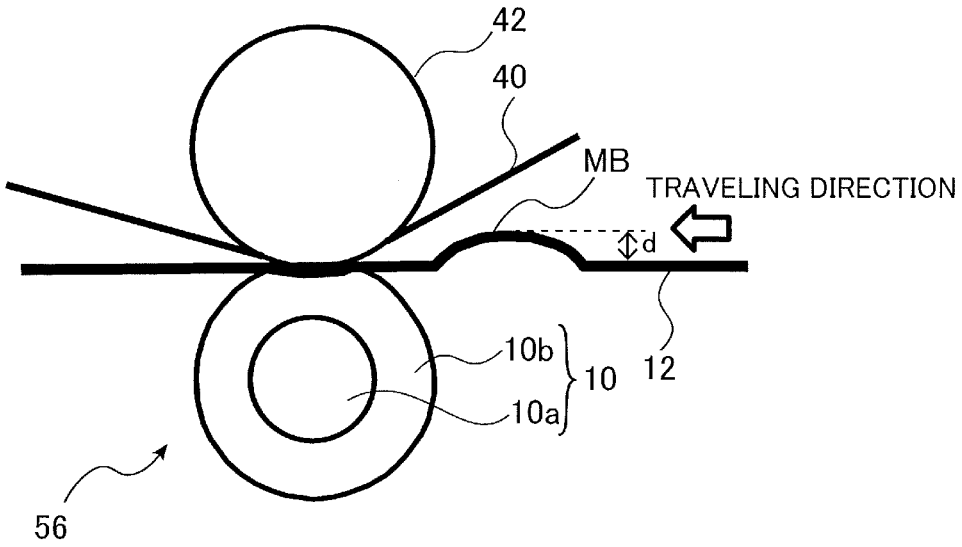
FIG. 9A is a schematic diagram illustrating a state before the curling passes a transfer portion.
Figure 9B:
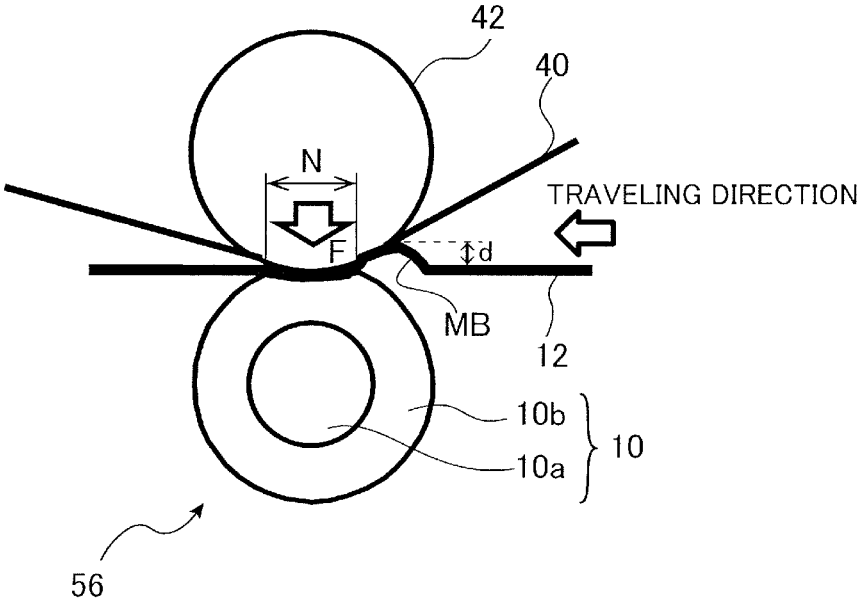
FIG. 9B is a schematic diagram illustrating a state before the curling passes the transfer portion.
Figure 10:
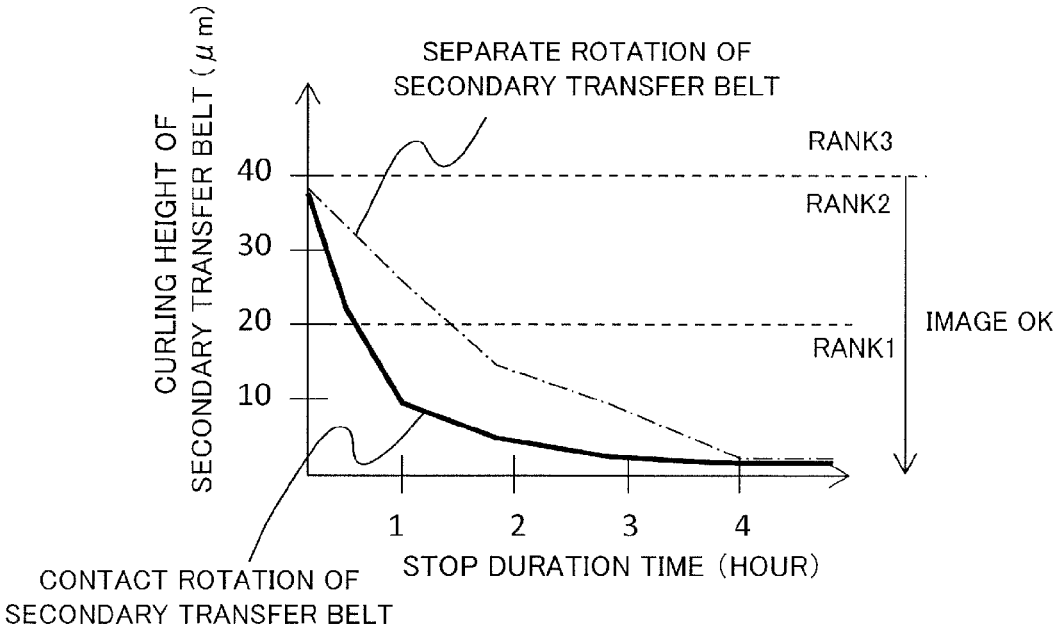
FIG. 10 is an explanatory view of an effect of the secondary transfer belt passing the transfer portion in a pressurized state.

FIG. 8 is a flowchart showing a control according to Embodiment 2. FIGS. 9A and 9B are schematic diagrams showing a removal of curling in the transfer portion. FIG. 10 is an explanatory view showing an effect of having the secondary transfer belt pass through the transfer portion in a pressurized state.

As shown in FIG. 2B, after the previous image forming job has been completed, the secondary transfer belt 12 is stopped in a state separated from the intermediate transfer belt 40 via the contact-separation mechanism 56M (S201: Y).

As shown in FIG. 8 with reference to FIG. 1, when the stop duration time of the secondary transfer belt 12 reaches a threshold value Tm (S202: Y), the controller 50 activates a drive motor M58 and moves the secondary transfer belt unit 56 to a contact position by a the pressurizing cam 58. Thereby, the secondary transfer belt 12 contacts the intermediate transfer belt 40, forming the transfer portion N (S203).

The controller 50 starts to perform rotational driving of the intermediate transfer belt 40 and the secondary transfer belt 12 (S204). Thereby, as shown in FIG. 9A, the curling portion MB of the secondary transfer belt 12 passes the transfer portion (the secondary transfer outer roller 10), and as shown in FIG. 9B, the curling height d of the curling portion MB is reduced.

When the stretch position move time of the secondary transfer belt 12 has elapsed, the controller 50 stops the rotational driving of the intermediate transfer belt 40 and the secondary transfer belt 12 (S205). After stopping, the controller 50 operates the drive motor M58 in an opposite direction from the contact state, and moves the secondary transfer belt unit 56 to the separated position (S206).

As shown in FIG. 5B, after stopping the intermediate transfer belt 40 and the secondary transfer belt 12, the stretched position of the secondary transfer belt 12 corresponding to the stretch roller (23) having an outer diameter of 12 mm has the curling that influences the output image the earliest. Therefore, the threshold value Tm of the stop duration time is set to one hour and 45 minutes, earlier than the time the curling of the stretched position of the stretch roller (23) having an outer diameter of 12 mm influences the output image.

As shown in FIG. 9A, when the secondary transfer belt unit 56 contacts the intermediate transfer belt 40, in the transfer portion N, the secondary transfer outer roller 10 is pressed against the secondary transfer inner roller 42 so as to nip the intermediate transfer belt 40 and the secondary transfer belt 12. At this time, the cross-sectional shape of the secondary transfer inner roller 42 maintains a round shape since the roller has a configuration where a thin rubber layer is formed on a surface of a core metal. However, the secondary transfer outer roller 10 has a thick elastic layer 10*b* formed of foamed rubber arranged on the circumferential surface of the core metal 10*a*, the contour is deformed along the cross-section of the secondary transfer inner roller 42, forming the transfer portion N whose length in the conveying direction is approximately 4 mm.

As shown in FIG. 9B, when the curling portion MB of the secondary transfer belt 12 overlapped with the intermediate transfer belt 40 passes the transfer portion N, a force F is applied to a direction opposite to the projection of the curling, so that an effect of canceling the curling can be obtained. In Embodiment 2, the stretch position move time of the intermediate transfer belt 40 is set so that the stretched portion by the stretch roller (23) having an outer diameter of 12 mm of the secondary transfer belt 12 passes the transfer portion N and stops. The stretch position move time of the intermediate transfer belt 40 is set so that the intermediate transfer belt 40 and the secondary transfer belt are moved for 90 mm in the process of being accelerated to 300 [mm/sec]. Therefore, the time during which the intermediate transfer belt and the secondary transfer belt 12 are rotated is 0.4 seconds or less, and the necessary change of stretched positions can be completed without attracting the attention of the user excessively.

As shown in FIG. 9A, according to Embodiment 1, the curling that has occurred to the secondary transfer belt 12 in the position stretched by the stretch roller (23) is moved to a position deflected from the stretch roller (23), so that the height d can be prevented from growing higher. However, according to Embodiment 1, the movement for changing the stretched positions of the secondary transfer belt 12 is executed in a state where the secondary transfer belt 12 is separated from the intermediate transfer belt 40, so that substantially a same amount of time is required as the stop duration time before the curling is cancelled. As shown in FIG. 10, approximately one and a half hours is required to recover the maximum curling height of rank 2 to the maximum curling height d of rank 1. If image forming is started immediately after moving the stretched positions of the secondary transfer belt 12 and the intermediate transfer belt 40, an image having a deteriorated quality close to rank 3 will be output.

In contrast, according to Embodiment 2, the curling can be recovered speedily during the 0.4-second stretch position move time to a level close to rank 1, so that the time for recovering the curling from a rank 2 level to a rank 1 level can be shortened to approximately 30 minutes. When image forming is started immediately after executing the movement of stretched positions of the secondary transfer belt 12 and the intermediate transfer belt 40, a high-level image close to rank 1 can be output.

Also according to Embodiment 2, the stretch position move time of the intermediate transfer belt 40 and the secondary transfer belt 12 is set so that the stretched positions by the respective stretch rollers after the movement are displaced from the stretched positions by the respective stretch rollers before the movement. Since curling possibly occurs in both the intermediate transfer belt 40 and the secondary transfer belt 12, the stretch position move time (move distance) is set so that the respective curling positions do not stop at the respective positions of the stretch rollers.

However, according to Embodiment 2, since the stretch position move time of the intermediate transfer belt 40 and the secondary transfer belt 12 is the same, it may be not possible to satisfy the above-described condition for all the stretched positions of the stretch rollers. In that case, it is allowable to have the stretched positions corresponding to the stretch roller having the largest diameter of the intermediate transfer belt 40 and the secondary transfer belt 12 overlap with the stretched positions of stretch rollers other than the stretch roller having the smallest diameter after the movement.

As described, even when the curling created before movement overlaps with the curling after the movement and increases, the curling is prevented from being deteriorated to a rank-3 level. If the stretched position by the stretch roller before the movement overlaps with the stretched position of a different stretch roller after the movement, there is a possibility that the curling grows to a rank-3 level before the subsequent stretched position movement is executed. This is caused by the curling shape caused by the shape of a different stretch roller formed cumulatively on an already existing curling.

(Effect of Embodiment 2)

According to Embodiment 2, the stopped state of the intermediate transfer belt 40 and the secondary transfer belt 12 are detected, and when the stopped state continues for a fixed time or longer, the secondary transfer belt unit 56 standing by in a separated state is moved to the contact position. Then, the overlap of the intermediate transfer belt 40 and the secondary transfer belt 12 is moved for a necessary stretch position move time within the transfer portion N in the pressurized state. Thereby, the curling of the secondary transfer belt 12 can be recovered significantly during the movement of the intermediate transfer belt 40 and the secondary transfer belt 12. By having the secondary transfer belt 12 contact the intermediate transfer belt 40 and having the two belts driven to be rotated and stopped at the same timing, it becomes possible to suppress the occurrence of image detects caused by curling, and to suppress the frequency of movement of the belts when the image forming apparatus 100 is in a stopped state.

According to Embodiment 2, when the stretched positions by the stretch rollers of the intermediate transfer belt 40 and the secondary transfer belt 12 are changed, pressure is added to the intermediate transfer belt 40 and the secondary transfer belt 12 and the belts are rotated for the same amount of time, and then the applied pressure is released. When the intermediate transfer belt 40 and the secondary transfer belt 12 are rotated periodically, the transfer portion N is set to a pressurized state, so that the overlap of the intermediate transfer belt 40 and the secondary transfer belt 12 is pressed in the conveyance direction using a roller having an elastic layer and a roller that does not have an elastic layer. Thus, a so-called "curl removing function by a rubber roller and a hard roller" acts on the secondary transfer belt 12, by which the recovery time of curling is shortened, and the curling can be cancelled efficiently.

According to Embodiment 2, the secondary transfer belt 12 is rotated, and after the stretched position by the stretch roller having the smallest diameter of the secondary transfer belt 12 (when the second belt starts to rotate) passes the transfer portion N, the secondary transfer belt 12 is stopped. Thereby, the influence of the most serious curling can be removed infallibly.

Embodiment 3

Embodiment 3 provides a belt cleaning unit using a fur brush attached to the secondary transfer belt 12 in the image forming apparatus illustrated in FIGS. 1 through 5. The configurations and controls other than those related to the belt cleaning unit are the same as Embodiment 2, so that the areas common to Embodiment 2 are not described in Embodiment 3.

(Belt Cleaning Unit)

Figure 11:
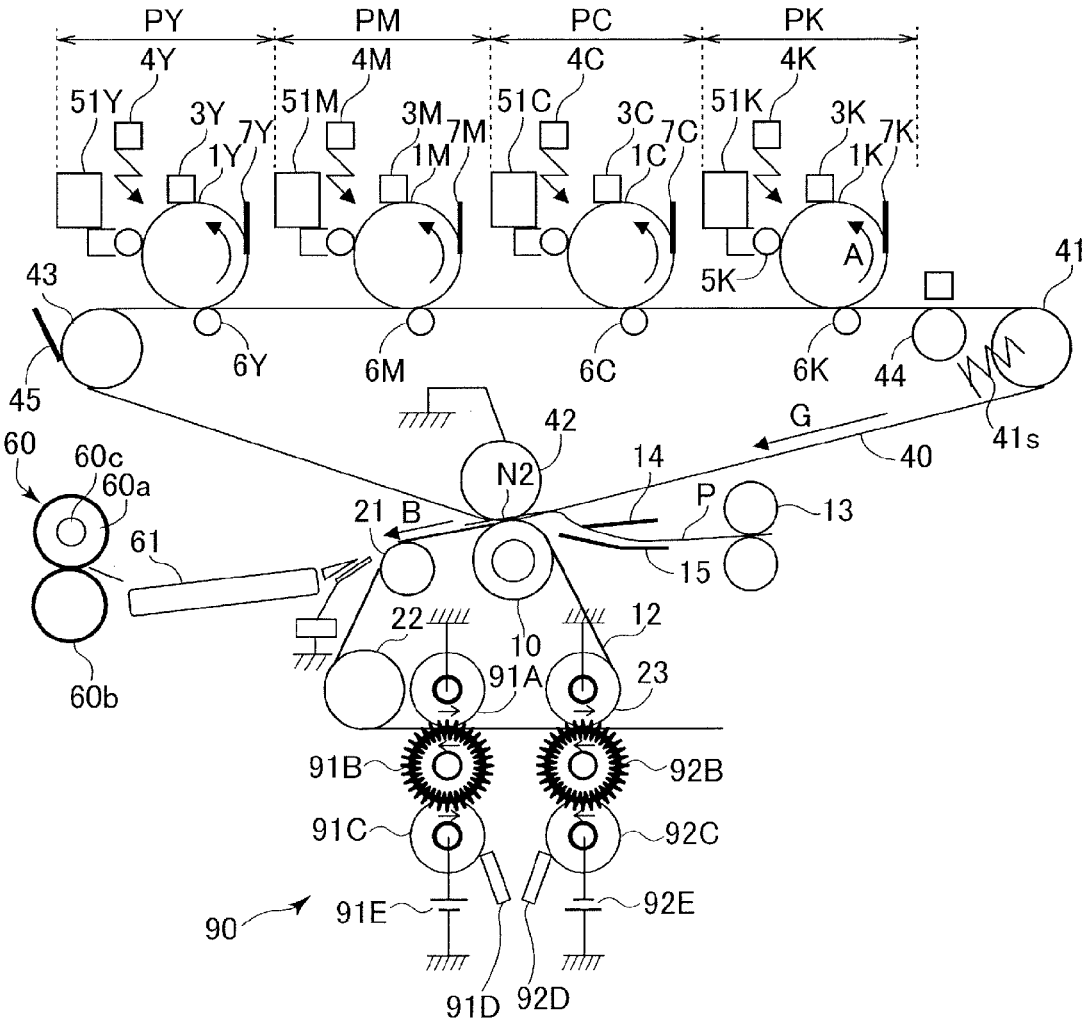
FIG. 11 is an explanatory view of an arrangement of a belt cleaning unit.

FIG. 11 is an explanatory view showing a configuration of an image forming apparatus according to Embodiment 3. As shown in FIG. 11, the image forming apparatus 100 forms density patches of respective colors at the intervals of toner images (image intervals) being transferred to the recording medium on the intermediate transfer belt 40, and measures the density (reflection light quantity of infrared light) of the density patches on the intermediate transfer belt 40. Therefore, a portion of the density patches may be adhered from the intermediate transfer belt 40 to the secondary transfer belt 12 in addition to transfer residual toner of the toner image transferred to the recording medium. The secondary transfer belt 12 contacts the recording medium at all times, so that depending on the recording medium classification, paper dust on the recording medium may adhere to the secondary transfer belt 12. When there is a patch toner image for control used for performing feedback control regarding laser power, developing bias, toner supply and so on, a portion of the toner of the patch toner image for control may adhere to the secondary transfer belt 12. When a jammed-sheet processing is performed, the toner image that had not been transferred to the recording medium may be adhered to the secondary transfer belt 12.

Therefore, a belt cleaning unit 90 adopting an electrostatic cleaning method is arranged to the secondary transfer belt 12 in the image forming apparatus 100, to remove and collect the toner, paper dust, additive agent and the like remaining on the secondary transfer belt. Patent Literature 3 shows a belt cleaning unit attached to an intermediate transfer belt. Patent Literature 4 shows a belt cleaning unit attached to a secondary transfer belt. These belt cleaning units are electrostatic cleaning apparatuses using a conductive fur brush. The belt cleaning unit adopting an electrostatic cleaning method will not have toner slip therethrough, unlike the cleaning apparatus with a cleaning blade that contacts the target surface when paper dust, additives, wax and the like are attached to the blade edge. Further, problems such as the cleaning blade curling up or noise caused by stick-slip will not occur.

(Belt Cleaning Unit)

As shown in FIG. 11, fur brushes 91B and 92B are driven by a drive motor not shown, and rotate in a direction opposite to the rotating direction of the secondary transfer belt 12 while sliding against the secondary transfer belt 12 having its inner side surface supported by a support roller 91A and the drive roller 23. The fur brushes 91B and 92B as examples of a conductive brush member contact the secondary transfer belt 12 and rotate. Power supplies 91E and 92E supply voltage to the fur brushes 91B and 92B to collect the toner attached to the secondary transfer belt 12.

A voltage having a positive polarity is applied to the fur brush 91B by having a rotating metallic roller 91C to which a DC voltage having a positive polarity is applied via the power supply 91E rotate in sliding motion against the brush. The negatively charged toner, paper dust and the like attached to the secondary transfer belt 12 is first transferred from the secondary transfer belt 12 to the fur brush 91B, and thereafter, transferred to the metallic roller 91C. A cleaning blade 91D slides against the metallic roller 91C and recovers the toner from the metallic roller 91C. Further, the toner whose charged polarity has been changed to positive charge while being attached to the fur brush 91B and rotated therewith is recovered from the fur brush 91B and returned to the secondary transfer belt 12.

A voltage having a negative polarity is applied to the fur brush 92B by having a rotating metallic roller 91C to which a DC voltage having a negative polarity is applied via the power supply 92E rotate in sliding motion against the brush. The positively charged toner, paper dust and the like attached to the secondary transfer belt 12 is first transferred from the secondary transfer belt 12 to the fur brush 92B, and thereafter, transferred to the metallic roller 92C and recovered by a cleaning blade 92D. The cleaning blade 92D slides against the metallic roller 92C and recovers the toner from the metallic roller 92C.

(Displaced Toner when Secondary Transfer Belt has Stopped)

When the secondary transfer belt 12 and the fur brushes 91B and 91C are stopped, the toner falling from the fur brushes 91B and 91C may gather near the contact portion of the secondary transfer belt 12. When the secondary transfer belt 12 is rotated for 20 to 100 mm to cancel the curling of the secondary transfer belt 12, as disclosed in Embodiments 1 and 2, a striped pattern formed by the attached toner may be formed 20 to 100 mm downstream from the fur brushes 91B and 91C. If the image forming is started by rotating the secondary transfer belt 12 in this state, the toner attached to the secondary transfer belt 12 may blow up and contaminate the inside of the apparatus.

Therefore, in Embodiment 3, when the secondary transfer belt 12 is rotated to cancel the curling of the secondary transfer belt 12, normal image forming voltage is applied to the fur brushes 91B and 91C in advance. Thereby, the secondary transfer belt 12 is rotated to cancel the curling in a state where the toner displaced to the secondary transfer belt 12 from the fur brushes 91B and 91C while the apparatus is stopped is recovered again.

(Control According to Embodiment 3)

Figure 12:
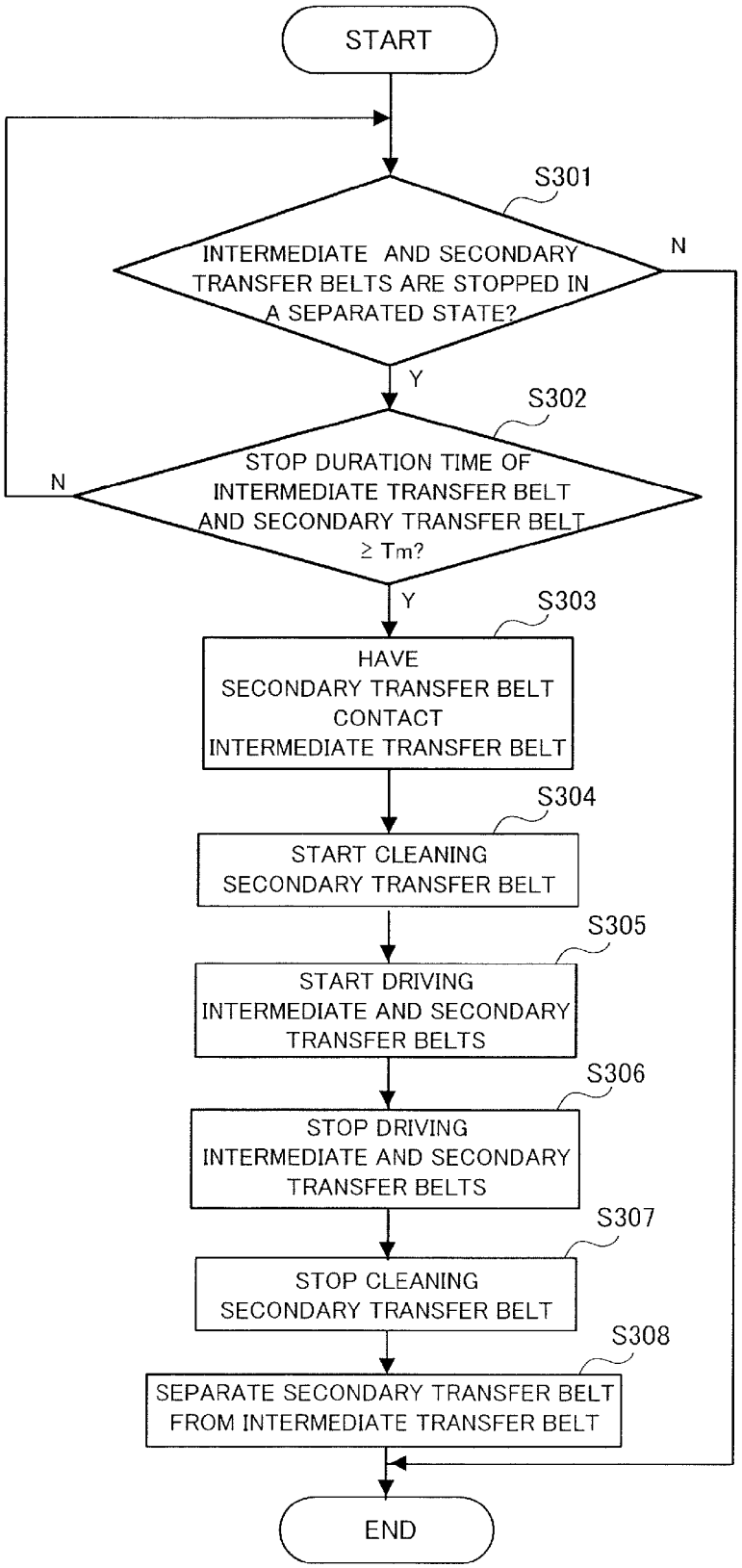
FIG. 12 is a flowchart of control according to Embodiment 3.

FIG. 12 is a flowchart of control according to Embodiment 3.

As shown in FIG. 12 with reference to FIG. 11, after the previous image forming job has been completed, the secondary transfer belt 12 is stopped in a state separated from the intermediate transfer belt 40 by the contact-separation mechanism 56M (S301: Y). When the stop duration time of the secondary transfer belt 12 reaches the threshold value Tm (S302: Y), the controller 50 activates the drive motor M58, and moves the secondary transfer belt unit 56 to the contact position via the pressurizing cam 58. Thereby, the secondary transfer belt 12 contacts the intermediate transfer belt 40, and the transfer portion N is formed (S303).

After the controller 50 activates the power supplies 91E and 92E and applies a normal voltage to the metallic roller 91C and 91D (S304), the rotational drive of the intermediate transfer belt 40 and the secondary transfer belt 12 is started (S305).

When the controller 50 moves the stretched positions of the secondary transfer belt 12 for a necessary amount, it stops the rotational drive of the intermediate transfer belt 40 and the secondary transfer belt 12 (S306). After stopping the belts, the controller stops the power supplies 91E and 92E, and when the voltage of the metallic rollers 91C and 91D drops (S307), the controller activates the drive motor M58 and moves the secondary transfer belt unit 56 to the separated position (S308).

In the secondary transfer belt 12, the amount of time until a defective transfer occurs by the drive roller 23 having the smallest outer diameter of 12 mm among the stretch rollers is two hours and ten minutes. Therefore, the time interval for activating the secondary transfer belt 12 intermittently to remove curling is set to one hour and forty-five minutes, shorter than the time the curling of the secondary transfer belt 12 influences the image. The polarity of the toner recovered during image forming will not change while the apparatus is stopped, so that in Embodiment 3, the conditions of a cleaning voltage applied to the metallic rollers 91C and 92C are the same as during image forming. The negatively charged toner recovered by the fur brush 91B positioned upstream during image forming is retained in the fur brush 91B by the same positive voltage as during image forming. The positively charged toner recovered by the fur brush 92B positioned downstream during image forming is retained in the fur brush 92B by the same negative voltage applied during image forming.

(Effect of Embodiment 3)

In Embodiment 3, after voltage is applied to the fur brushes 91B and 92B from the power supplies 91E and 92E, the secondary transfer belt 12 is rotated and stopped. Therefore, the toner having been displaced from the fur brushes 91B and 92B to the secondary transfer belt 12 while the voltage has been stopped is not rotated together with the secondary transfer belt 12. By applying a normal cleaning voltage to the fur brushes 91B and 92B before rotationally driving the secondary transfer belt 12, the toner collected in the fur brushes 91B and 92B can be prevented from being attached again to the secondary transfer belt 12. Thereby, the toner can be prevented from scattering when the secondary transfer belt 12 is rotated to cancel curling. Thus, it becomes possible to prevent the toner from being re-attached to the secondary transfer belt 12 and contaminating the recording medium passing the transfer portion N, the secondary transfer belt 12 from slipping, or transfer irregularities from occurring to the image on the recording medium by the unevenness of the attached toner.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-196384, filed Sep. 26, 2014, which is hereby incorporated by reference herein in its entirety.

What is claimed is:

1. An image forming apparatus comprising:

a toner image forming portion configured to form a toner image on an image bearing member;

a rotatable endless first belt bearing the toner image transferred from the image bearing member;

a rotatable endless second belt bearing a recording medium;

a plurality of first stretch rollers including a first transfer roller, the plurality of first stretch rollers stretching the first belt;

a plurality of second stretch rollers including a second transfer roller, the plurality of second stretch rollers stretching the second belt, the first and second transfer rollers forming a transfer portion where the toner image is transferred to the recording material, with the first belt and the second belt disposed between the first and second transfer rollers;

a contact-separation mechanism configured to change a state of the transfer portion between a contact state in which the first and second belts contact each other and a separation state in which the first and second belts separate from each other; and a controller rotating and stopping the first belt such that a rotational position of the first belt with respect to the first stretch rollers is changed and rotating and stopping the second belt such that a rotational position of the second belt with respect to the second stretch rollers is changed, based on a stop duration time of at least either the first belt or the second belt, the controller rotating the first belt and the second belt for different amounts of time in the separation state and overlapping a time from starting to stopping the rotation of the first belt and a time from starting to stopping the rotation of the second belt.

2. The image forming apparatus according to claim 1, wherein the controller stops the second belt so that a stretched position of the second belt corresponding to a stretch roller, having a smallest diameter among the plurality of second stretch rollers, when the second belt is started to rotate does not stop at a position corresponding to the transfer portion when the second belt is stopped.

3. The image forming apparatus according to claim 1, wherein an amount of movement from starting to stopping the rotation of the second belt is set in a range of 20 mm to 100 mm.

4. The image forming apparatus according to claim 1, wherein a time from starting to stopping the rotation of the second belt is set in a range of 0.1 seconds to 0.5 seconds.

5. The image forming apparatus according to claim 1, further comprising:

a conductive brush member rotating while being in contact with the second belt; and a power supply configured to apply voltage to the conductive brush to recover toner attached to the second belt, wherein the controller rotates and stops the second belt after applying the voltage to the conductive brush member from the power supply.

* * * * *